United States Patent [19]

Pidde et al.

[11] Patent Number: 4,807,888

[45] Date of Patent: Feb. 28, 1989

[54] DEVICE FOR THE AUTOMATIC OPERATION OF INTERNATIONAL METALLIC SILHOUETTE TARGET PLATFORMS

[76] Inventors: Victor S. Pidde, 377 Avro St., Albury, 2640; John D. Langdon, 24 Hawksview Road, Wirlinga N.S.W. 2640, both of Australia

[21] Appl. No.: 88,231

[22] Filed: Aug. 24, 1987

[51] Int. Cl.[4] ..... F41J 7/04

[52] U.S. Cl. ..... 273/392

[58] Field of Search ..... 273/391, 392

[56] References Cited

U.S. PATENT DOCUMENTS

| | | | |
|---|---|---|---|
| 2,736,558 | 2/1956 | Ruderman | 273/391 |
| 3,064,976 | 11/1962 | Kuhn | 273/391 X |
| 4,732,394 | 3/1988 | Stein et al. | 273/391 |
| 4,739,996 | 4/1988 | Vedder | 273/392 |

*Primary Examiner*—Anton O. Oechsle

[57] ABSTRACT

The invention relates to an automatic target rising device intended primarily for use in a form of shooting competition known as "International Metallic Silhouette". This device includes a target mounted platform with guide slots attached to its lower surface. These slots are engaged by retaining bars which are mounted on pedestals with a sloping rear edge. This allows the target to fall by a combination of pivoting on and sliding over the retaining bars at the top rear edge of the pedestals. The target is reset by means of a rotatably mounted lever which transfers the force and movement of a linear actuator to the lower surface of a fallen target platform immediately behind the guide slots, enabling the target to be raised by a combination of sliding over and pivoting on the retaining bars and pivoting on the end of the lever which returns to its original position after resetting the target. The lever is driven by a linear actuator which is mounted between it and an anchorage point on the base plate of the device. Due to this arrangement the heaviest target used can be reset with an actuator of moderate power and a target mounted on the device responds to bullet impact in a very similar manner to a freestanding target.

5 Claims, 3 Drawing Sheets

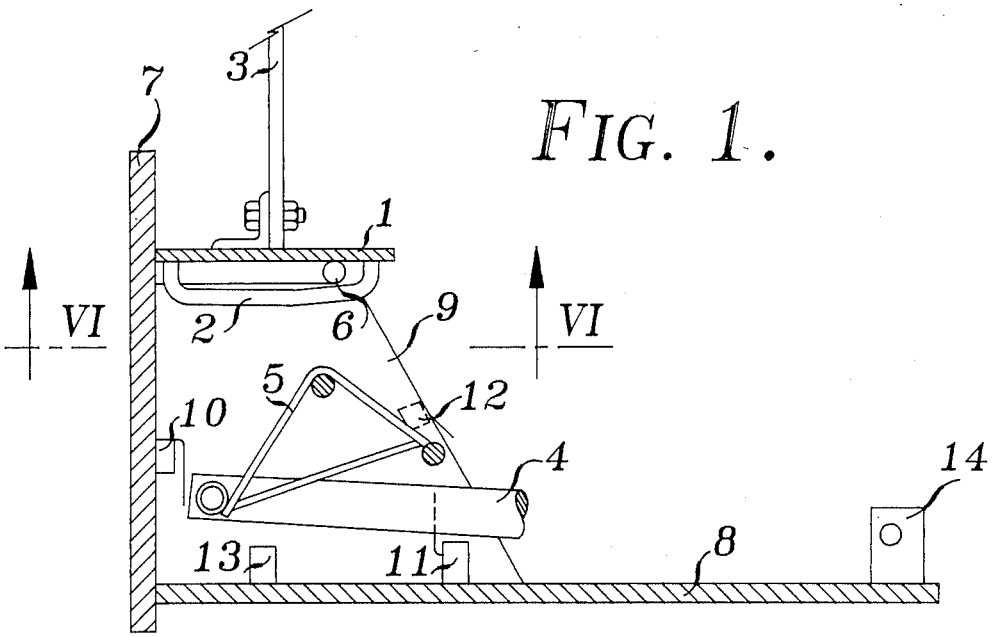
FIG. 1.
FIG. 2.
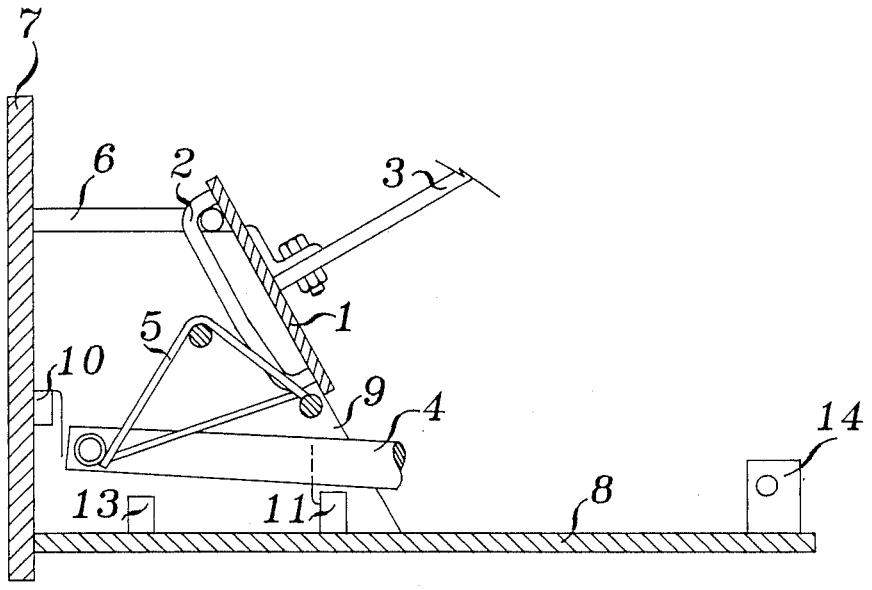

FIG. 3.
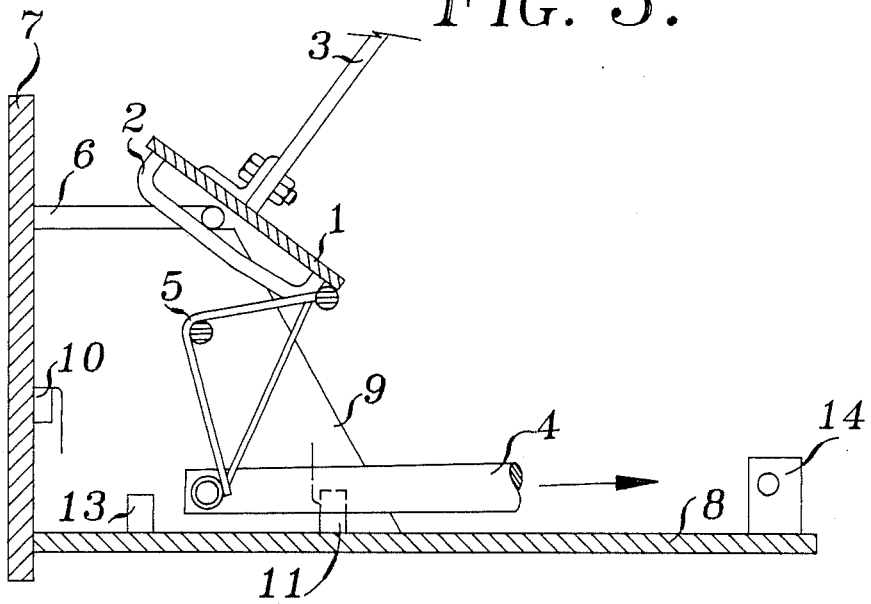
FIG. 5.
FIG. 4.
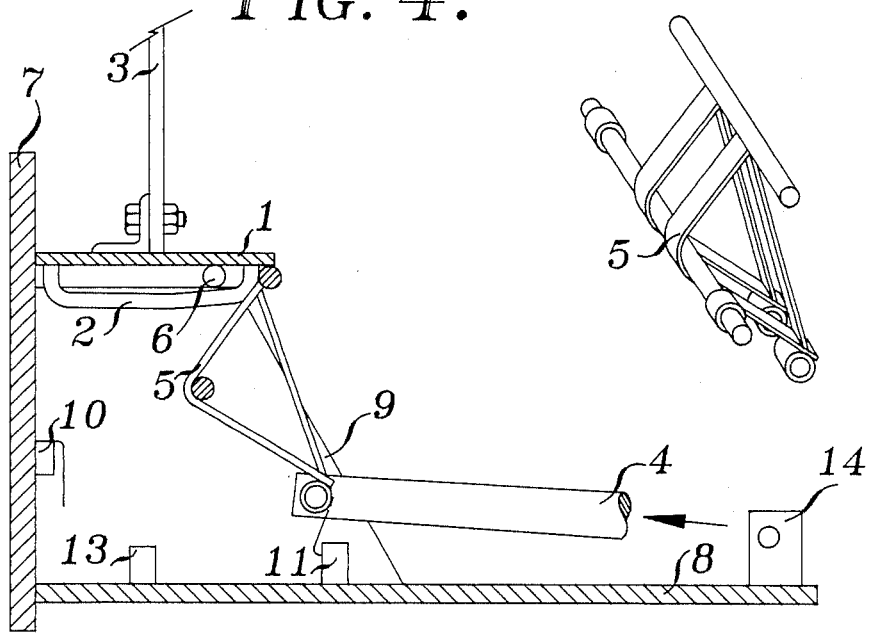

DEVICE FOR THE AUTOMATIC OPERATION OF INTERNATIONAL METALLIC SILHOUETTE TARGET PLATFORMS

The present invention relates to an automatic target raising device intended primarily for use in a form of shooting competition known as "International Metallic Silhouette". The targets for this competition consist of full size silhouettes of animals, that is: a ram, a pig, a turkey, and a chicken. The material used is 10 mm to 13 mm toughened steel plate. The targets are at this present set up by hand at distances of up to 500 meters from the firing line. The target is positioned a prescribed distance from the edge of a fixed platform. Shooters have to carry out this task as they complete each round of competition, and it can become very time consuming. In addition physically handicapped shooters usually find it impossible to compete as they cannot reset the heavy targets.

A score can only be made when a bullet hits the target and causes it to fall over. If the target is hit near the top it usually falls by pivoting about a horizontal axis through its base, if hit near the bottom the base is pushed backwards off the platform and then the target falls over, if the target is hit near either end it will also pivot about a vertical axis as it falls over. In each of these cases the only outside force available to cause the target to move and fall is supplied by the kinetic energy of the bullet which strikes the target.

The present invention seeks to provide a device which will reset metallic silhouette targets to their original starting positions without changing their characteristic behaviour from that of a freestanding target (as previously described) and also to eliminate human error in resetting targets.

Accordingly the present invention provides a device for the automatic operation of international metallic silhouette target platforms, said device including a target mounting platform with two inclined guide slots attached to its lower surface, retaining bars which engage the guide slots and permit the characteristic falling behaviour of a freestanding target, pedestals of right trapezoidal shape with their front edges perpendicular to the top and bottom edges and the rear edges sloping, the retaining bars being integral with and attached to the top edges of the pedestals, the effective portion of the retaining bars being positioned at the top rear corner of the pedestals, said pedestals being mounted on a base plate, and providing the mounting for a front protector plate, and a pivoted target resetting lever, said lever transferring the force and movement of a linear actuator to the lower surface of a fallen target platform immediately behind the guide slots, enabling the target to be raised by a combination of sliding over and pivoting on the retaining bars, and pivoting on the end of the lever, which returns to its original position after resetting the target, said actuator being mounted between the said lever and an anchorage point provided on the base plate. While the preferred actuation method is by means of an electromechanical device it is possible to use hydraulic or pneumatic actuators.

Due to this arrangement the heaviest target used can be reset with an actuator of moderate power and a target mounted on the device responds to bullet impact in a very similar manner to a freestanding target.

The invention will be further described, by way of example only with reference to the accompanying drawing in which:

FIG. 1 is a cross-sectional view, taken on line II—II of FIG. 7 in the direction of the arrows, showing the device in its normal position.

FIG. 2 is a cross-sectional view similar to FIG. 1 but showing the device in the target down position.

FIG. 3 is a cross-sectional view similar to FIG. 1 but showing the device in a partially reset position.

FIG. 4 is a cross-sectional view similar to FIG. 1 but showing the device in the target reset position.

FIG. 5 is an oblique view of the resetting lever which is designated in the drawing by the numeral 5.

Figure 6:
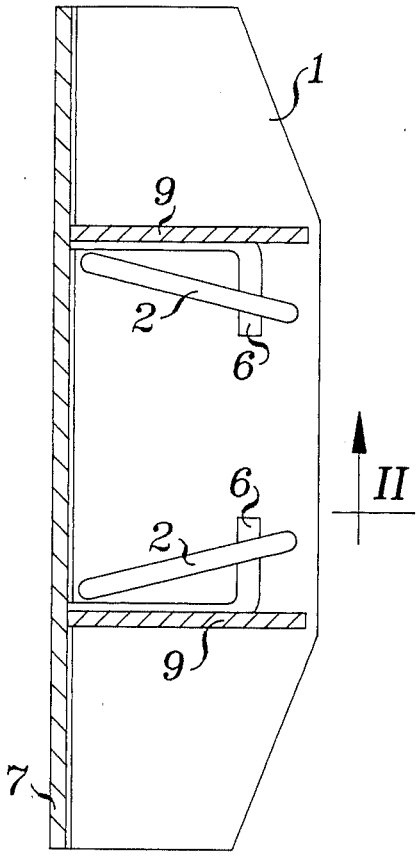
FIG. 6 is a cross-sectional view, taken on line VI—VI of FIG. 1 in the direction of the arrows.
Figure 7:
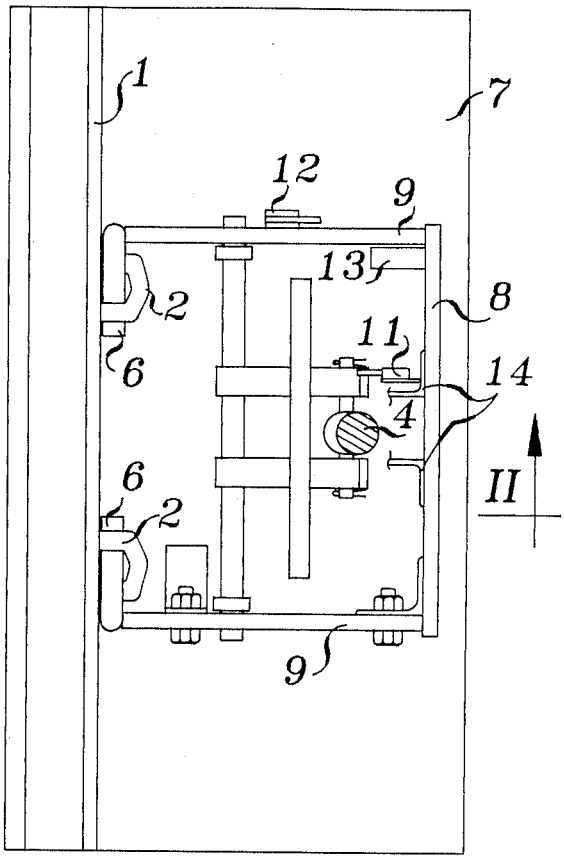
FIG. 7 is a rear elevational view of the device.

The automatic target raising device shown in the drawings consists of a target mounting platform 1 with inwardly inclined guide slots 2 attached to its lower surface. The guide slots 2 are engaged by retaining bars 6 so as to keep the target mounting platform 1 loosely attached to the pedestals 9. A base plate 8 provides a mounting for the pedestals 9 which in turn provide the mountings for the front protector plate 7 and the bearing points for the cross-shaft of the pivoted target resetting lever 5, an electromechanical linear actuator 4 is fitted between the lever 5 and the mounting point 14 provided on the base plate 8. Limit switches 10, 11 and 12 and a relay assembly 13 are used to control the flow of electric current from an external supply (not shown) to the motor of the linear actuator 4. A target 3 is shown attached to the platform 1 (except in FIG. 6 and FIG. 7).

Figure 8:
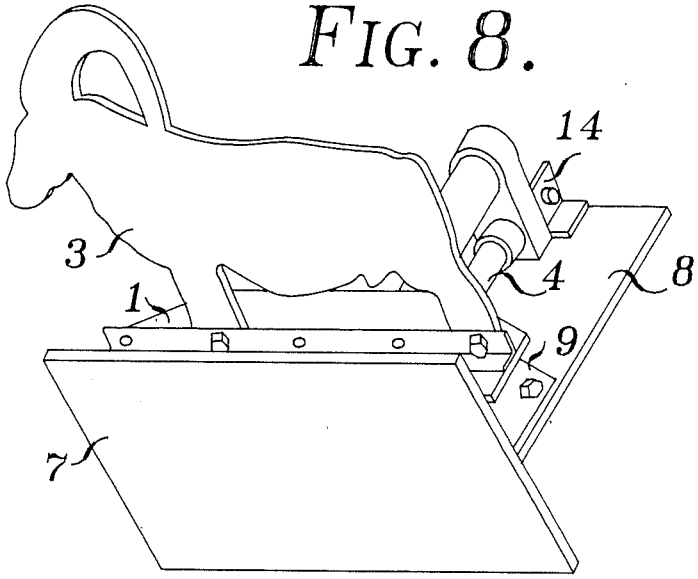
FIG. 8 is an isometric view illustrating a device embodying our invention.

The device operates as follows: Bullet impact on the standing target 3 (FIG. 1 and FIG. 8) will cause the target to fall by pivoting on the retaining bars 6 and then sliding down the rear edge of the pedestals 9 or by sliding horizontally backwards over and then pivoting on the retaining bars 6 or by swivelling up to fifteen degrees to right or left and then pivoting on and sliding over the retaining bars 6 or by any combination of the preceding movements. Irrespective of the exact movement by which the target 3 falls, it and the mounting platform 1 always come to rest in the same target down position (FIG. 2). In this position the inside corners formed by the attachments of the rear ends of the guide slots 2 to the platform 1 engage a bar which is fitted to the end of the resetting lever 5. The fallen target also activates the actuator motor by means of the limit switch 12 and the relay assembly 13, this causes the resetting lever 5 to rotate from its ready position (as shown in FIG. 1 and FIG. 2) to the target reset position (FIG. 4), the bar on the end of the lever 5 pushing against the engaged corners of the platform 1 and guide slots 2 thus causing the platform 1 and its guide slots 2 to slide over and pivot on the retaining bars 6 thus resetting the target (FIG. 3). The reset position is detected by the limit switch 11 which causes the linear actuator to reverse its direction and to return the lever 5 to the ready position (FIG. 1 and FIG. 2), which is in turn detected by limit switch 10 which causes the actuator motor to stop. The target is now ready for the next shot.

It will be appreciated that although the device described is intended for use with a self-contained power supply such as a lead acid storage battery and is also intended to be automatic in operation, the power unit may be fitted for direct mains operation and the device may be remotely controlled either by radio or by wire.

We claim:

1. A device for the automatic operation of international metallic silhouette target platforms, comprising a single metallic silhouette target, a target platform to which the said target is attached, means for supporting and retaining said target platform while it falls by sliding over and pivoting on said supporting means, resetting means for returning the target platform to its normal position by a combination of sliding over and pivoting on said supporting means and pivoting on said resetting means.

2. A device for the automatic operation of international metallic silhouette target platforms comprising a single metallic silhouette target, a target platform to which the said target is attached, means for supporting and retaining said target platform while it falls, said means including two pedestals of right trapezoidal shape with their front edges perpendicular to the top and bottom edges and their rear edges sloping, retaining bars which are integral with and attached to the top edges of said pedestals, the effective portion of said retaining bars being positioned at the top rear corners of said pedestals, two guide slots which are attached to the lower surface of said target platform, said guide slots being rearwardly inwardly inclined and engaged by said retaining bars, the action of said guide slots in combination with said retaining bars ensuring that said target always comes to rest in the same target down position after falling by any combination of sliding and pivoting movement of said guide slots over and on said retaining bars.

3. A device defined in claim 2 and resetting means for returning the said target platform to its normal position, said resetting means comprising a lever rotatably mounted with its bearings in said pedestals, said lever consisting of a bar a fulcrum shaft, an attachment point for a linear actuator and a frame connecting the last three parts mentioned, the said lever transmitting the force and movement of said linear actuator to the lower surface of said fallen target platform by means of said bar which is engaged by the inside corners formed by the attachments of the rear ends of said guide slots to the said target platform enabling said target to be reset by a combination of sliding and pivoting of said guide slots over and on said retaining bars and pivoting of said inside corner on said bar.

4. A device for the automatic operation of international metallic silhouette target platforms comprising a target mounting platform with two rearwardly inwardly inclined guide slots attached to its lower surface, retaining bars which engage said guide slots and permit the characteristic falling behaviour of a free-standing target, pedestals of right trapezoidal shape with their front edges perpendicular to the top and bottom edges and the rear edge sloping, said retaining bars being integral with and attached to the top edges of said pedestals, the effective portion of said retaining bars being positioned at the top rear corners of said pedestals, the action of said retaining bars in conjunction with said guide slots and said pedestals being such that said target platform always comes to rest in the same target down position resting against the sloping edges of said pedestals, said pedestals being mounted on a base plate, and providing the mountings for a front protector plate and a rotatably mounted lever, said lever consisting of a bar a fulcrum shaft an attachment point for a linear actuator and a frame connecting the last three parts mentioned, the said lever transmitting the force and movement of said linear actuator to the lower surface of said fallen target platform by means of said bar which is engaged by the inside corners formed by the attachments of the rear ends of said guide slots to the lower surface of said target platform enabling said target platform to be reset by a combination of sliding and pivoting of said guide slots over and on said retaining bars and pivoting of said inside corners on said bar which is part of said lever, said lever returning to its original position after resetting said target platform, said linear actuator being mounted between the said lever and an anchorage point provided on said base plate.

5. A device defined in claim 4 and means for retracting and extending said linear actuator and controlling the extension and retraction thereof, said means including an electric motor, three switches a relay and means mounted on said target platform, said lever, and said linear actuator to control said switches.

* * * * *